US006430961B1

(12) United States Patent
Pompl

(10) Patent No.: US 6,430,961 B1
(45) Date of Patent: Aug. 13, 2002

(54) PROCESS AND DEVICE FOR THE LOW-TEMPERATURE FRACTIONATION OF AIR

(75) Inventor: Gerhard Pompl, Beilngries (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/692,198

(22) Filed: Oct. 20, 2000

(30) Foreign Application Priority Data

Oct. 20, 1999 (DE) ..... 199 50 570

(51) Int. Cl.[7] ..... F25J 1/00
(52) U.S. Cl. ..... 62/643; 62/903
(58) Field of Search ..... 62/643, 903

(56) References Cited

U.S. PATENT DOCUMENTS

| | | | | |
|---|---|---|---|---|
| 4,006,001 A | | 2/1977 | Schonpflug | |
| 5,071,458 A | * | 12/1991 | Grenier et al. | 62/903 |
| 5,224,351 A | * | 7/1993 | Jeannot et al. | 62/903 |
| 5,507,356 A | * | 4/1996 | Roth et al. | 62/903 |
| 5,735,141 A | * | 4/1998 | Whitlock | 62/903 |
| 5,761,927 A | | 6/1998 | Rakesh et al. | |
| 5,775,129 A | | 7/1998 | Clarke et al. | |
| 5,901,574 A | | 5/1999 | Rohde | |

FOREIGN PATENT DOCUMENTS

| | | |
|---|---|---|
| EP | 0 410 832 | 1/1991 |
| EP | 0 469 780 | 2/1992 |
| EP | 0 795 349 | 9/1997 |

* cited by examiner

*Primary Examiner*—Ronald Capossela
(74) *Attorney, Agent, or Firm*—Millen, White, Zelano & Branigan, P.C.

(57) ABSTRACT

The process and the apparatus are used for the low-temperature fractionation of air. Charge air (1) which has been compressed and has undergone prior purification is introduced into a rectifier system for nitrogen/oxygen separation. This system comprises a pressure column (2), a low-pressure column (3) and a condenser/evaporator system (101, 102, 103) for heating the low-pressure column (3). The condenser/evaporator system has a first section (101) which is designed as a falling-film evaporator. A first oxygen-rich liquid (6) from the low-pressure column (3) is introduced into the evaporation passages of the falling-film evaporator (101), where it is partially evaporated. In the process, an oxygen-rich vapor (11) and a second oxygen-rich liquid (12) are formed. At least part of the oxygen-rich vapor (11) is returned to the low-pressure column (3). The condenser/evaporator system additionally has a second section (102, 103), which is designed at least in part as a forced circulation evaporator (103). At least some of the second oxygen-rich liquid (12, 13) is passed, by means of a delivery device (14), to the evaporation passages of the second section (102, 103) of the condenser/evaporator system.

13 Claims, 1 Drawing Sheet

Fig. 1
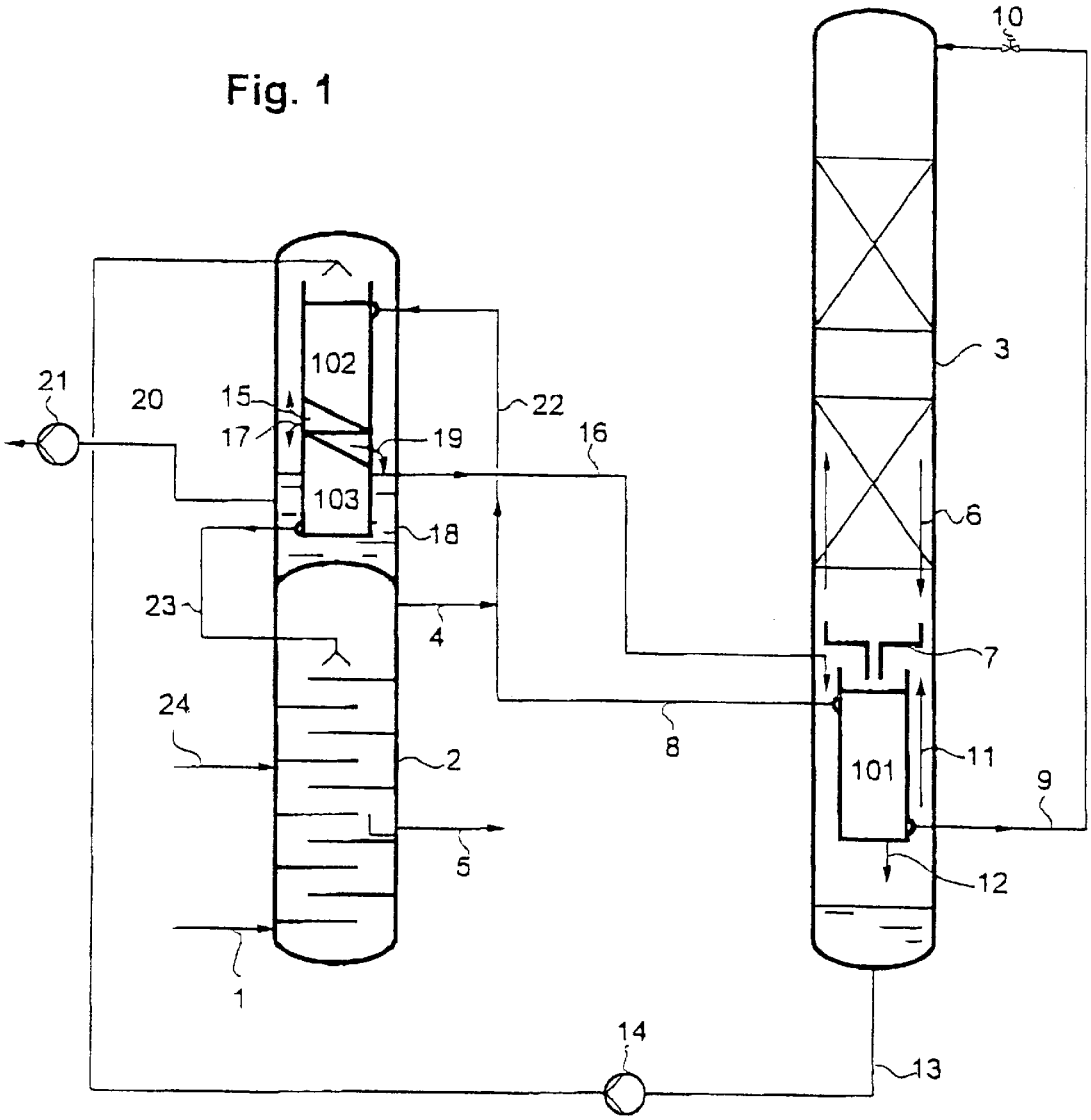
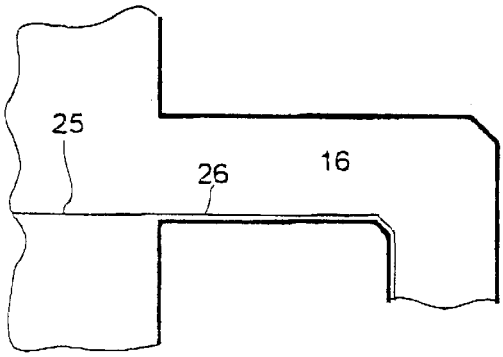
Fig. 2

PROCESS AND DEVICE FOR THE LOW-TEMPERATURE FRACTIONATION OF AIR

The invention relates to a process for the low-temperature fractionation of air.

The general principles of low-temperature fractionation of air and the design of rectifier systems for nitrogen/oxygen separation with two or more columns in particular are known from the monograph "Tieftemperaturtechnik" (Low-Temperature Technology) by Hausen/Linde (2nd edition, 1985) or from an article by Latimer in Chemical Engineering Process (Vol. 63, No. 2, 1967, page 35). The pressure column (also commonly termed "high pressure column" in the United States) and low-pressure column of a two-column system generally exchange heat via a condenser/evaporator system (principal condenser), in which top gas from the pressure column is liquefied against evaporating bottom liquid from the medium-pressure column.

The rectifier system of the invention may be designed as a conventional two-column system, but also as a three-column or multicolumn system. In addition to the columns for nitrogen/oxygen separation, it may have further devices for obtaining other components of air, in particular noble gases, for example to obtain argon.

A heat exchanger which is designed as a condenser/evaporator has evaporation passages and liquefaction passages. A liquid is evaporated in the evaporation passages. They are in heat-exchanging contact with the liquefaction passages, in which a gaseous fraction condenses in indirect heat exchange with the evaporating liquid. Details of evaporation procedures are given, for example, in the monograph "Verdampfung und ihre technischen Anwendungen" [Evaporation and technical applications thereof] by Billet (1981). A condenser/evaporator may be composed of one or more heat-exchanger blocks. A condenser/evaporator system has one or more condenser/evaporators.

For decades, the low-temperature fractionation of air used almost exclusively forced circulation evaporators as condenser/evaporators. In this type of evaporator, a heat-exchanger block is arranged in a bath of the liquid which is to be evaporated. The evaporation passages are open at the top and bottom. Liquid from the bath is entrained upwards by the gas formed during the evaporation (thermosiphon effect) and flows back into the liquid bath. In this way, a natural circulation of liquid is provided purely by the evaporation operation, without mechanical energy being supplied.

For some time, falling-film evaporators have also been used as condenser/evaporators in air fractionation installations, as described, for example, in EP 681153 A or EP 410832 A. In this type of evaporator, the liquid which is to be evaporated enters the evaporation passages at the top and flows downwards as a relatively thin film along the walls which separate the evaporation passages and liquefaction passages. This type of evaporator has a particularly low pressure, loss in the evaporation passages and is therefore generally more favourable in terms of energy than a forced circulation evaporator.

However, during evaporation of an oxygen-rich liquid, total evaporation, which would lead to the evaporation passages running dry, must be prevented. For this purpose, liquid emerging from the evaporation passages is generally returned to the inlet of the evaporation passages by means of a pump. Firstly, this measure is detrimental to the energy-saving action of the falling-film evaporator; secondly, levels of undesirable constituents with a low volatility in the liquid are increased.

The invention is therefore based on the object of providing a process of the type described in the introduction and a corresponding apparatus which can be operated economically and particularly favourably in terms of operating technology and in particular have a particularly low energy consumption.

This object is achieved by the features of the characterizing part of patent claim 1. Although, as in standard falling-film evaporation, the liquid which is not evaporated in the falling-film evaporator (first section of the condenser/evaporator system), i.e. the second oxygen-rich liquid, is fed to a delivery device, for example a pump, this device does not convey the liquid back to the inlet of the evaporation passages of the same falling-film evaporator, but rather to a second section of the condenser/evaporator system. Consequently, the first section only has to carry out a relatively small part, for example 30 to 50%, preferably 38 to 42%, of the total evaporation capacity of the condenser/evaporator system. The natural proportion of liquid at the outlet of the evaporation passages of the falling-film evaporator is correspondingly high. It is thus possible to dispense completely or to a large extent with an artificial circulation of liquid. The delivery device allows the liquid which has not been evaporated for the time being to flow onwards to a second section of the condenser/evaporator system. This second section is designed completely or partially as a forced circulation evaporator, where the problem of the need for an artificial circulation of liquid does not occur, or occurs to a lesser extent.

Within the context of the invention, it has emerged that with the aid of the measures according to the invention, the volume of pumped liquid can be reduced to approximately 30%. The effect of the reduced pumping capacity on the energy balance is not restricted to the driving energy saved; rather, the benefit is based to a greater extent on the reduced introduction of heat which results from the smaller delivery volume of second oxygen-rich liquid.

In the process according to the invention, the oxygen product is preferably removed from the second section of the condenser/evaporator system, either as a gas or as a liquid. In the latter case, it is possible, if appropriate, to obtain a gaseous pressurized oxygen product in addition to a liquid oxygen product by bringing oxygen-rich liquid in the liquid state to an elevated pressure and then evaporating it against air or nitrogen (so-called internal compression).

The first section of the condenser/evaporator system of the invention may be arranged inside the low-pressure column or in a separate vessel.

The process according to the invention and the corresponding apparatus can be used for any type of nitrogen/oxygen separation, in particular independently of the purity of the products in the heads and bottoms of the columns.

The vapour which is produced in the evaporation passages of the second section of the condenser/evaporator system is preferably not exclusively or primarily removed as a gaseous oxygen product, but rather at least half of this vapour is introduced into the low-pressure column, where it is used as rising vapour. If the entire oxygen product is obtained in liquid form and/or is internally compressed it is also possible for all the gas produced in the second section of the condenser/evaporator system to be returned to the low-pressure column.

A third oxygen-rich liquid remains in the second section of the condenser/evaporator system, as the unevaporated part of the second oxygen-rich liquid. It preferably collects in the liquid bath of the or one forced circulation evaporator. In the process according to the invention, it is preferable for at least some of this third oxygen-rich liquid to be returned to the low-pressure column and/or to the evaporation passages of the first section of the condenser/evaporator system. This returning may advantageously be carried out together with the abovementioned return of vapour to the low-pressure column, as a result of a suitable line being arranged at the height of the liquid level in the bath. This at the same time regulates the liquid level in the forced circulation evaporator without additional control devices being required.

If the second section is partially designed as a second falling-film evaporator, it is additionally possible for the delivery device which is in any case present between the first and second sections additionally to be used to produce a circulation of liquid at the second falling-film evaporator.

The liquefaction passages of the condenser/evaporator system are preferably connected to the two columns in the way which is described in patent claim 4. As a result, it is possible to dispense with pumps at these locations, even if the pressure column and low-pressure column are arranged next to one another. (In this case it is advantageous if the first section of the condenser/evaporator system is arranged beneath the bottom plate of the low-pressure column and the second section of the condenser/evaporator system is arranged above the top plate of the pressure column.)

The first section, which is designed as a falling-film evaporator, is preferably dimensioned in such a way that in this evaporator, condensation of a nitrogen-rich gas fraction from the pressure column leads to the formation of the amount of nitrogen-rich liquid which is required as reflux in the low-pressure column (plus, if appropriate, the amount removed as unpressurized liquid product). This represents, for example, a proportion of 30 to 50%, preferably 38 to 42%, of the total heat-transfer capacity of the condenser/evaporator system. The remainder of the heat transfer (50 to 70%, preferably 58 to 62%), is carried out in the second section of the condenser/evaporator system, specifically in such a way that at least the amount of liquid which is required as reflux in the pressure column is produced therein.

For reasons of the spatial distribution of the heating surface, it may in some cases be more advantageous for a larger proportion of the nitrogen-rich fraction than that described above to be condensed in the first section, in order for a corresponding amount of heating surface to be displaced from the second section (generally at the head of the pressure column) to the first section (generally in the bottom of the low-pressure column). In this case, some of the first nitrogen-rich liquid which is formed in the first section is fed to the pressure column as reflux. This may require the use of a liquid pump.

The nitrogen-rich gas fraction is generally formed by head nitrogen in the pressure column.

The first section of the condenser/evaporator system is preferably designed exclusively as a falling-film evaporator. With the aid of the dimensions outlined above, it may particularly advantageously be produced as an individual, relatively compact block or in the form of a plurality of (for example four) particularly low blocks which are arranged next to one another. An arrangement directly in the bottom of the low-pressure column is also advantageous with a view to achieving a low structural height of the installation and its insulation (coldbox).

The second section of the condenser/evaporator system may be formed by at least two partial sections which are connected in series on the evaporation side and the first of which is designed as a falling-film evaporator and the second of which is designed as a forced circulation evaporator. The liquid which flows out of the evaporation passages of the partial section which is in the form of a falling-film evaporator is, for example, introduced into the liquid bath of the or one partial section which is in the form of a forced circulation evaporator. The falling-film evaporator/forced circulation evaporator combination may, for example, be equipped with continuous liquefaction passages, as described in detail in EP 795349 A. In this case, the liquid from the bath of the forced circulation evaporator may be returned to the low-pressure column or to the outlet of the evaporation passages of the first section of the condenser/evaporator system and may be used to increase the amount of liquid in that partial section of the second section which is designed as a falling-film evaporator.

The invention also relates to an apparatus for the low-temperature fractionation of air.

BRIEF DESCRIPTION OF THE DRAWINGS

The invention and further details thereof are explained in more detail below with reference to two exemplary embodiments, which are diagrammatically depicted in FIGS. 1 and 2, for obtaining gaseous pressurized oxygen.

DETAILED DESCRIPTION OF THE DRAWINGS

According to FIG. 1, gaseous charge air 1, which has previously been compressed, purified and cooled to approximately dew point (not shown), is fed to the pressure column 2 directly above the bottom. The pressure column 2 forms part of a rectifier system which, in addition, has a low-pressure column 3 and a principal condenser in the form of a condenser/evaporator system 101, 102, 103. In the pressure column 2, the air is fractionated to form head nitrogen and an oxygen-enriched liquid. In this specific exemplary embodiment, the latter is not, as is customary, removed at the bottom, but rather a few theoretical or practical plates higher, via line 5. (Details of this procedure, which is used to hold back constituents of relatively low volatility can be found in the German Patent Application of earlier date 19835474 and the applications in other countries which correspond to this application.) The oxygen-enriched liquid 5 is restrictedly metered into the low-pressure column 3, via a line which is not shown, at an intermediate location.

In the upper region of the low-pressure column 3, one or more nitrogen products are removed (not shown). Below the bottom rectifying section, oxygen is obtained in the purity required for the product. This oxygen flows off the bottom plate or packing section of the low-pressure column 3 as a first oxygen-rich liquid and is collected in a collection device 7. The first oxygen-rich liquid flows onwards to the top end of the first section 101 of the condenser/evaporator system and is introduced into the evaporation passages thereof. The first section 101 is designed as a falling-film evaporator, where approximately 28 to 30% of the first oxygen-rich liquid 7 evaporates in indirect heat exchange with a first part 8 of the nitrogen-rich gas fraction 4 from the head of the pressure column 2. In the process, the nitrogen-rich gas 8 is condensed to form a first nitrogen-rich liquid 9, which is expanded in a restrictor valve 10 and is fed in its entirety to the head of the low-pressure column 3 as reflux. Since, in this example, there is no liquid nitrogen product produced, the falling-film evaporator 101 is dimensioned in such a way that in this evaporator precisely the amount of nitrogen-rich gas 8 which is required as reflux liquid for the low-pressure column is condensed.

The vapour 11 which is produced in the first section 101 of the condenser/evaporator system flows back to the bottom rectifier section of the low-pressure column and takes part in the countercurrent mass exchange inside this column. The fraction 12 which remains in liquid form forms a second oxygen-rich liquid which is removed via line 13 and is passed by means of a pump 14 to the second section of the condenser/evaporator, which is formed by a combination of a further falling-film evaporator 102 and a forced circulation evaporator 103 as described in detail in EP 795349 A.

The second oxygen-rich liquid flows downwards in the evaporation passages of the further falling-film evaporator 102, where approximately 40% of this liquid evaporates. All the vapour 15 which is formed is returned to the low-pressure column 3 via line 16, since in this example there is no oxygen which is removed directly from the rectifier system as a gaseous product. The line 16 simultaneously serves to maintain a constant liquid level in the liquid bath 18, in that excess liquid is passed to the low-pressure column 3 together with the vapour formed in the second section 102, 103. (This function is explained in more detail below with reference to the detailed drawing shown in FIG. 2.) The remaining liquid 17 from the partial section 102 flows into the liquid bath 18 of the forced circulation evaporator 103 and, together with the liquid 19 which has been transferred to the forced circulation evaporator, forms a third oxygen-rich liquid, which is obtained as an oxygen product by being partially removed via line 20, internally compressed by means of a pump 21, evaporated under elevated pressure in the known way and finally discharged as a gaseous pressurized product. If some of the charge air is used as a heat-transfer medium for the evaporation of the product oxygen, the air stream 24 which is liquefied in the process can be introduced into the pressure column 2 at an intermediate point. As an alternative or in addition, it is possible to condense a nitrogen stream which has been raised to a pressure above that of the pressure column against the evaporating product oxygen (nitrogen circuit, not shown).

The liquefaction passages of the further falling-film evaporator 102 and the forced circulation evaporator 103 are continuous. They are acted on by a second part 22 of the nitrogen-rich gas fraction 4 from the pressure column 2. The nitrogen firstly flows through the falling-film evaporator 102 and then through the forced circulation 103 and is at least partially, and preferably almost completely, condensed. All the second nitrogen-rich liquid 23 which is formed in the process is fed to the pressure column 2 as reflux.

FIG. 2 shows details of the connection between the line 16 and the outer space around the two condenser/evaporators 102, 103 which form the second section of the condenser/evaporator system. The dimensions of the line are designed substantially according to the amount of gas which is to be conveyed. The line is arranged in such a way that liquid can overflow from the liquid bath of the forced circulation evaporator 103 and flow back into the low-pressure column 3 or into the bottom liquid beneath the first falling-film evaporator 101 as a film 26 on the underside of the line 16. As a result, the level of the liquid bath of the forced circulation evaporator 103 can be kept constant without dedicated control measures.

FIG. 3 differs from FIG. 1 through the presence of an additional line 301, via which some of the first nitrogen-rich liquid 9 can be fed to the pressure column 2 as reflux. In the arrangement of columns and condensers illustrated, a liquid pump 302 is required in order to overcome the static height between first section 101 of the condenser/evaporator system and upper region of the pressure column 2. In the variant shown in FIG. 3, compared to FIG. 1, it is thus possible, with the aid of this transfer of liquid into the pressure column, to shift more heating surface into the first section 101, which is in this case designed as a bottom evaporator in the low-pressure column 3. Correspondingly less heating surface, (and therefore a smaller volume) is required for the second section 102, 103, which in this example is at the head of the pressure column 2. In this way, it is possible to optimize the spatial distribution of the condenser/evaporator system. The advantage of this optimization is in many cases greater than the cost of the additional line 301 and the liquid pump 302.

In an extreme example (not shown in the drawing), it is possible for all the heating surface of the partial section 102 to be integrated in the first section 101, so that the second section of the condenser/evaporator system then only comprises a forced circulation evaporator 103.

The preceding embodiments can be repeated with similar success by substituting the generically or specifically described variants and/or operating conditions of this invention for those used in the preceding embodiments.

The entire disclosure of all applications, patents and publications, cited above and below, and of corresponding German Appl. No. 19950570.5 are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An apparatus for the low-temperature fractionation of air, having a rectifier system for nitrogen/oxygen separation, which system has a pressure column (2), a low-pressure column (3), and a condenser/evaporator system (101, 102, 103) for heating the low-pressure column (3), in which apparatus the condenser/evaporator system has a first section (101), which is designed as a falling-film evaporator, and having a charge-air line (1) for introducing charge air (1) which has been compressed and has undergone prior purification into the pressure column (2), means for passing oxygen-enriched air from the pressure column to the low pressure column, means for feeding a first oxygen-rich liquid (6) from the low-pressure column (3) into the evaporation passages of the falling-film evaporator (101) to the low-pressure column (3), characterized in that the condenser/evaporator system has a second section (102, 103) which is designed at least in part as a forced circulation evaporator (103), and the apparatus has means for introducing a second oxygen-rich liquid (12, 13) from the evaporation passages of the falling-film evaporator (101) to the evaporation passages of the second section (102, 103) of the condenser/evaporator system, which means comprise a delivery device (14).

2. Apparatus according to claim 1, characterized in that pressure column (2) and low-pressure column (3) are arranged next to one another, the first section (101) of the condenser/evaporator system being arranged beneath the bottom plate or the bottom packing section of the low-pressure column (3) and/or the second section of the condenser/evaporator system being arranged above the top plate or the top packing section of the pressure column (2).

3. Apparatus according to claim 1, characterized in that the first section (101) of the condenser/evaporator system is designed exclusively as a falling-film evaporator.

4. Apparatus according to claim 1, characterized in that the second section of the condenser/evaporator system is formed by at least two partial sections which are connected in series on the evaporation side and the first of which is designed as a falling-film evaporator (102) and the second of which is designed as a forced circulation evaporator (103).

5. Apparatus according to claim 1, characterized in that the outlet (9) of the liquefaction passages of the first section (101) of the condenser/evaporator system is connected to the pressure column (2) via a liquid line (301) and, if appropriate, via a liquid pump (302).

6. In a process for the low temperature separation of air into nitrogen and oxygen comprising separating feed air in a rectification system comprising a pressure column (2), a low pressure column (3) and a condenser/evaporator system (101, 102, 103) in communication with the pressure column (2) and the low pressure column (3):

the improvement wherein the condenser/evaporator system comprises a first section comprising a falling film evaporator zone (101) and characterized in that a second section comprises a forced circulation evaporator zone (103), and said process comprising:

passing a first oxygen-enriched liquid (6) from the low pressure column into evaporation passages of the falling film evaporator zone (101), to form an oxygen rich vapor (11) and a second oxygen-rich liquid (12), returning at least part of the oxygen-rich vapor (11) to the low pressure column (3), and passing at least part of the second oxygen-rich liquid (12) to evaporation passages in the forced circulation evaporator zone to evaporate further liquid (12).

7. A process according to claim 6, characterized in that at least half of the vapor produced in the evaporation passages of the second section of the condenser/evaporator system is introduced (16) into the low-pressure column (3).

8. A process according to claim 6, characterized in that at least some of a third oxygen-rich liquid (18), which is formed from that part of the second oxygen-rich liquid (12, 13) which is not evaporated in the second section (102, 103) of the condenser/evaporator system, is returned (16) to the low-pressure column (3) and/or to the evaporation passages of the first section (101) of the condenser/evaporator system.

9. A process according to claim 6, characterized in that:

a nitrogen-rich gas fraction (4) is produced in the upper region of the pressure column (2), a first part (8) of the nitrogen-rich gas fraction (4) is introduced into the liquefaction passages of the first section (101) of the condenser/evaporator system, where it is at least partially condensed, forming a first nitrogen-rich liquid (9), a second part (22) of the nitrogen-rich gas fraction (4) is introduced into the liquefaction passages of the second section (102, 103) of the condenser/evaporator system, where it is at least partially condensed, forming a second nitrogen-rich liquid (23), the first nitrogen-rich liquid (9) is at least partially expanded (10) and fed to the low-pressure column (3) as reflux, and at least some of the second nitrogen-rich liquid (23) is fed to the pressure column (2) as reflux.

10. A process according to claim 9, characterized in that some of the first nitrogen-rich liquid (8) is fed (301, 302) to the pressure column (2) as reflux.

11. A process according to claim 6, characterized in that pressure column (2) and low-pressure column (3) are arranged next to one another, the first section (101) of the condenser/evaporator system being arranged beneath the bottom plate or the bottom packing section of the low-pressure column (3) and/or the second section of the condenser/evaporator system being arranged above the top plate or the top packing section of the pressure column (2).

12. A process according to claim 6, characterized in that the first section (101) of the condenser/evaporator system is designed exclusively as a falling-film evaporator.

13. A process according to claim 6, characterized in that the second section of the condenser/evaporator system is formed by at least two partial sections which are connected in series on the evaporation side, and of which at least one is designed as a falling-film evaporator (102) and at least one as a forced circulation evaporator (103).

* * * * *

UNITED STATES PATENT AND TRADEMARK OFFICE

CERTIFICATE OF CORRECTION

PATENT NO. : 6,430,961 B1
DATED : August 13, 2002
INVENTOR(S) : Gerhard Pompl

It is certified that error appears in the above-identified patent and that said Letters Patent is hereby corrected as shown below:

Column 6,
Lines 45-48, replace the paragraph with the following:
-- means for feeding a first oxygen-rich liquid (6) from the low-pressure column (3) into the evaporation
passages of the falling-film evaporator (101), and
means for returning oxygen-rich vapour (11) from the evaporation passages of the falling-film evaporator (101) to the low-pressure column (3), --

Signed and Sealed this

Twenty-seventh Day of January, 2004

JON W. DUDAS
*Acting Director of the United States Patent and Trademark Office*